US012543823B2

(12) United States Patent
Greenhalgh et al.

(10) Patent No.: US 12,543,823 B2
(45) Date of Patent: Feb. 10, 2026

(54) ARTICLE OF FOOTWEAR WITH PLATE AND HEEL SUPPORT

(71) Applicant: Reebok International Limited, Altrincham (GB)

(72) Inventors: John S. Greenhalgh, Foxboro, MA (US); Kyung Lee, Newton, MA (US)

(73) Assignee: Reebok International Limited, Altrincham (GB)

( * ) Notice: Subject to any disclaimer, the term of this patent is extended or adjusted under 35 U.S.C. 154(b) by 0 days.

(21) Appl. No.: 18/772,373

(22) Filed: Jul. 15, 2024

(65) Prior Publication Data

US 2026/0013598 A1 Jan. 15, 2026

(51) Int. Cl.
*A43B 21/26* (2006.01)
*A43B 17/02* (2006.01)

(52) U.S. Cl.
CPC ..... *A43B 21/26* (2013.01); *A43B 17/02* (2013.01)

(58) Field of Classification Search
CPC ..... A43B 21/26; A43B 17/02; A43B 13/12; A43B 13/026
USPC ..... 36/35 R
See application file for complete search history.

(56) References Cited

U.S. PATENT DOCUMENTS

| | | | | |
|---|---|---|---|---|
| 6,038,790 | A * | 3/2000 | Pyle | A43B 7/144 36/28 |
| 6,327,795 | B1 * | 12/2001 | Russell | A43B 13/12 36/27 |
| 11,297,894 | B1 | 4/2022 | Yang | |
| 2004/0111920 | A1 | 6/2004 | Cretinon | |
| 2005/0267775 | A1 | 12/2005 | Willis | |
| 2006/0283047 | A1 | 12/2006 | Schoenborn et al. | |
| 2007/0101617 | A1 | 5/2007 | Brewer et al. | |
| 2007/0256329 | A1 | 11/2007 | Antonelli et al. | |
| 2009/0188131 | A1 | 7/2009 | Doerer et al. | |
| 2009/0320330 | A1 * | 12/2009 | Borel | A43B 13/14 36/30 R |
| 2010/0293816 | A1 | 11/2010 | Truelsen | |
| 2011/0041365 | A1 | 2/2011 | Ludemann | |
| 2011/0126422 | A1 | 6/2011 | Vattes et al. | |
| 2015/0327624 | A1 * | 11/2015 | Grott | A43B 13/184 36/91 |
| 2023/0389650 | A1 | 12/2023 | Greenhalgh et al. | |

* cited by examiner

*Primary Examiner* — Timothy K Trieu
(74) *Attorney, Agent, or Firm* — Sterne, Kessler, Goldstein & Fox P.L.L.C.

(57) ABSTRACT

A sole for an article of footwear includes a midsole, a plate having longitudinal prongs in a forefoot portion of the sole and a dome-shaped heel support portion in a heel portion of the sole, an insert disposed within a cavity of the heel support portion, a heel rim securing the insert to the plate and the plate to the midsole; and an outsole.

20 Claims, 6 Drawing Sheets

ARTICLE OF FOOTWEAR WITH PLATE AND HEEL SUPPORT

FIELD

The present disclosure relates to articles of footwear and methods of making articles of footwear. In particular, embodiments relate to an article of footwear having a sole with a plate and a heel support portion.

BACKGROUND

Articles of footwear are used to enhance the wearer's walking and/or running experience. For example, a midsole may provide cushioning, support, and stability. Some articles of footwear are specifically designed for one specific athletic activity such as running, jumping, or weight lifting. As such, a shoe designed for running may not provide as good support for a weight lifter during a weight lifting activity as a shoe designed for weight lifting. However, some activities, for example cross-fit, require athletes to run, jump, and weight lift, and therefore traditionally designed shoes can be insufficient for these types of activities.

SUMMARY

Some embodiments of the disclosure provide a sole for an article of footwear including a midsole, a plate comprising having prongs in a forefoot portion of the sole and a dome-shaped heel support portion in a heel portion of the sole, an insert disposed within a cavity formed on a bottom surface of the heel support portion, a heel rim securing the insert to the plate and the plate to the midsole; and an outsole.

In some embodiments, the plate is thinner than the midsole.

In some embodiments, the insert is more resilient than the midsole under compression.

In some embodiments, the plate includes carbon fiber and is more rigid than the midsole and the insert.

In some embodiments, two of the longitudinal prongs of the plate are separated by a longitudinal gap.

In some embodiments, the longitudinal prongs are more rigid than rest of the plate.

In some embodiments, each of the longitudinal prongs includes a longitudinal indentation formed on a bottom surface of the respective longitudinal prong.

In some embodiments, the plate includes four longitudinal prongs separated by three longitudinal gaps, and the middle longitudinal gap extends deeper into the plate than the other two longitudinal gaps.

In some embodiments, a bottom surface of the midsole includes cavities, and the longitudinal prongs are at least partially disposed within the cavities.

In some embodiments, a bottom surface of the midsole includes a dome-shaped cavity, and the heel support portion is disposed within the dome-shaped cavity, with the heel support portion abutting the bottom surface of the midsole.

In some embodiments, the insert is asymmetrical in the direction from a lateral side to a medial side.

In some embodiments, an article of footwear includes an upper and the sole.

Some embodiments of the disclosure provide a sole for an article of footwear including a midsole, a dome-shaped heel support disposed underneath the midsole portion in a heel portion, an insert, and a heel rim for securing the insert to the heel support and the heel support to the midsole. The heel support includes a dome-shaped wall defining a cavity on a bottom surface, and flanges extending radially outwardly from an edge of the dome-shaped wall. The flanges are decoupled from each other. The insert is disposed within the cavity of the heel support.

In some embodiments, the flanges of the heel support portion includes three flanges extending radially outwardly from the edge, with a first flange on a lateral side, a second flange on a medial side, and a third flange on a rear side.

In some embodiments, each of the flanges includes a sidewall extending upwardly and coupled to a sidewall of the midsole.

In some embodiments, an underside of the midsole comprises a cavity, and the heel support portion is disposed within the cavity of the midsole, with the heel support portion abutting a bottom surface of the midsole.

In some embodiments, each of the flanges includes a sidewall to engage with a sidewall of the midsole.

In some embodiments, the sole also includes an outsole, and the insert is disposed between the outsole and the heel support.

In some embodiments, an article of footwear includes the sole and a heel clip disposed around the heel portion of the sole and crossing over the heel rim at separate locations: one at a medial side and one at a lateral side.

In some embodiments, the heel clip is stiffer than the heel rim.

BRIEF DESCRIPTION OF THE FIGURES

The accompanying drawings, which are incorporated herein and form part of the specification, illustrate embodiments and, together with the description, further serve to explain the principles of the embodiments and to enable a person skilled in the relevant art(s) to make and use the embodiments.

Figure 1:
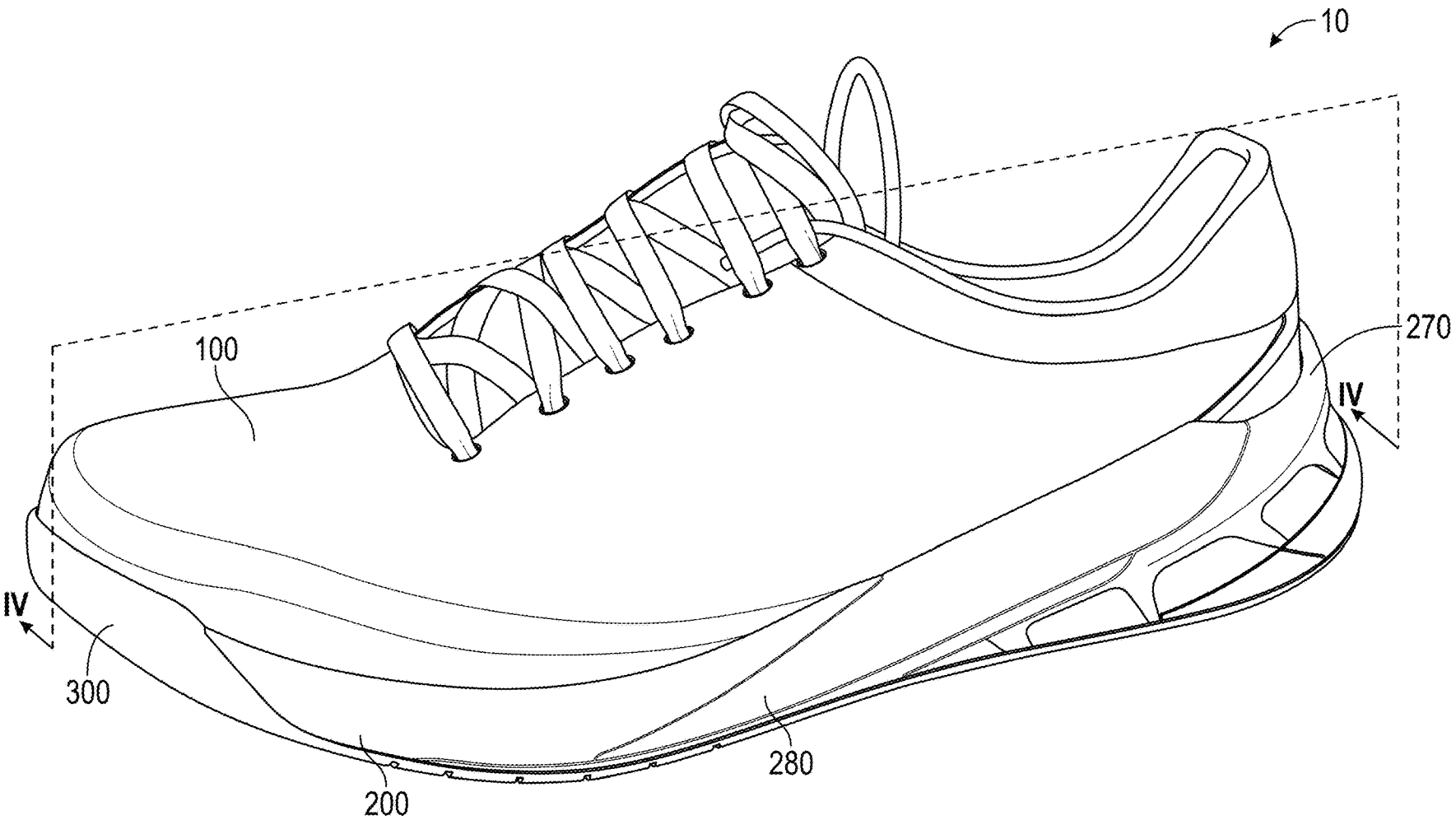
FIG. 1 is a perspective view of an article of footwear according to some embodiments.

The features and advantages of the embodiments will become more apparent from the detail description set forth below when taken in conjunction with the drawings, in which like reference characters identify corresponding elements throughout. In the drawings like reference numbers generally indicate identical, functionally similar, and/or structurally similar elements.

DETAILED DESCRIPTION

Embodiments of the present disclosure are described in detail with reference to embodiments thereof as illustrated in the accompanying drawings. References to "one embodiment," "an embodiment," "an exemplary embodiment," etc., indicate that the embodiment described can include a particular feature, structure, or characteristic, but every embodiment can not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The following examples are illustrative, but not limiting, of the present embodiments. Other suitable modifications and adaptations of the variety of conditions and parameters normally encountered in the field, and which would be apparent to those skilled in the art, are within the spirit and scope of the disclosure.

Articles of footwear are used to enhance the wearer's walking, running, and/or training experience. For example, a midsole may provide cushioning, support, and stability. Some athletic footwear are specific designed for one activity, such as running, weightlifting, or agility, but they may not be desirable for a different activity that they are not intended for. For example, footwear designed for running may include a carbon fiber plate, which is high strength, lightweight, and can provide a spring-like effect that increases energy return, but such footwear may not be as ideal for weight lifting, which can require greater support to prevent collapse of the sole. However, some activities, for example cross-fit, involve running, jumping, and weightlifting. Therefore, with traditionally-designed footwear, people would either prepare multiple pairs of footwear that target different activities to boost their performance, or wear one pair of footwear throughout different activities with compromised performance.

The present disclosure describes athletic footwear that has the lightweight feel and flexibility of a running shoe and also provides vertical stability during activities such as training or weightlifting. The article of footwear of the present disclosure includes a resilient plate underneath the midsole and a heel support portion disposed in the heel of the article of footwear, and may provide the desired level of cushioning, support, and stability to the wearer across different activities. For example, the heel support portion may provide vertical stability during training or weightlifting, while also allowing the sole of the article of footwear to accommodate shear loads during activities such as running, and the plate may increase strength and energy return on each strike during running.

The disclosed embodiments provide a midsole for an article of footwear having a resilient plate with a heel support portion. In some embodiments, the resilient plate is made of carbon fiber or the like. Carbon fiber material is lightweight, has high strength and rigidity, and has a resilient spring-like effect to provide energy return during running, which can help the wearer run with less energy and can reduce fatigue on the foot. The heel support portion provides vertical support to prevent the midsole from collapsing under vertical loads such as weightlifting, but also provides an optimal level of cushioning for physical activities such as running. The midsole may also be configured in a way that accommodates shear forces during running. Thus, the article of footwear may provide both stability to lift more weight and energy return to run faster and more comfortably.

In some embodiments, a resilient plate (e.g., carbon fiber plate) is coupled to the midsole. In some embodiments, the plate includes multiple prongs disposed and a heel support portion. In some embodiments, the heel support portion may be dome-shaped and define a cavity for housing an insert underneath. In some embodiments, the prongs are formed under the forefoot portion of the midsole and the heel support portion is formed in a heel portion of the midsole.

The geometric shape of the heel support portion allows for the resistance to vertical loads (e.g., during weightlifting), while still promoting the shearing and deflection of the midsole to stably and resiliently accommodate forces during activities such as running. The amount of vertical resistance provided by the heel support portion is determined based on the material, thickness, and geometry of the heel support portion and the insert housed within, as will be discussed in greater detail. For example, the more rigid the selected material, the greater the thickness of the material, and the smaller the height, the heel support portion will resist a greater amount of vertical force. In some embodiments, the heel support portion is provided with decoupling wings to reduce the rigidity of heel support portion in the horizontal direction, thereby allowing lateral movement and force accommodation of the midsole during activities such as running, but the rigidity in the vertical direction is not compromised.

An article of footwear 10 is shown in FIG. 1. In some embodiments, article of footwear 10 includes an upper 100, a midsole 200 coupled to upper 100, and in some embodiments, an outsole 300 coupled to midsole 200. Any suitable upper may be used as upper 100. In some embodiments, upper 100 may be made of woven single-layer or multi-layer portions, or other suitable materials. In some embodiments, upper 100 may be a knit material. Upper 100 may include a tongue and laces or may be tongueless. Other fastening systems besides shoelaces may be used. Although these examples are given, any other upper may also be used.

In some embodiments, upper 100 may be coupled to midsole 200 by stitching, bonding, or adhering. In some embodiments, midsole 200 may be coupled to outsole 300 by stitching, bonding, or adhering.

Midsole 200 provides support and cushioning to footwear 10. In some embodiments, midsole 200 is formed of foam. For example, midsole 200 may be formed of ethylene-vinyl acetate (EVA), expanded thermoplastic polyurethane particle foam (e-TPU), polyether block amide (PEBA), other suitable foams, and/or combinations thereof. In some embodiments, midsole 200 may be made of a combination of different materials (e.g., e-TPU particle foam and EVA foam).

Figure 2:
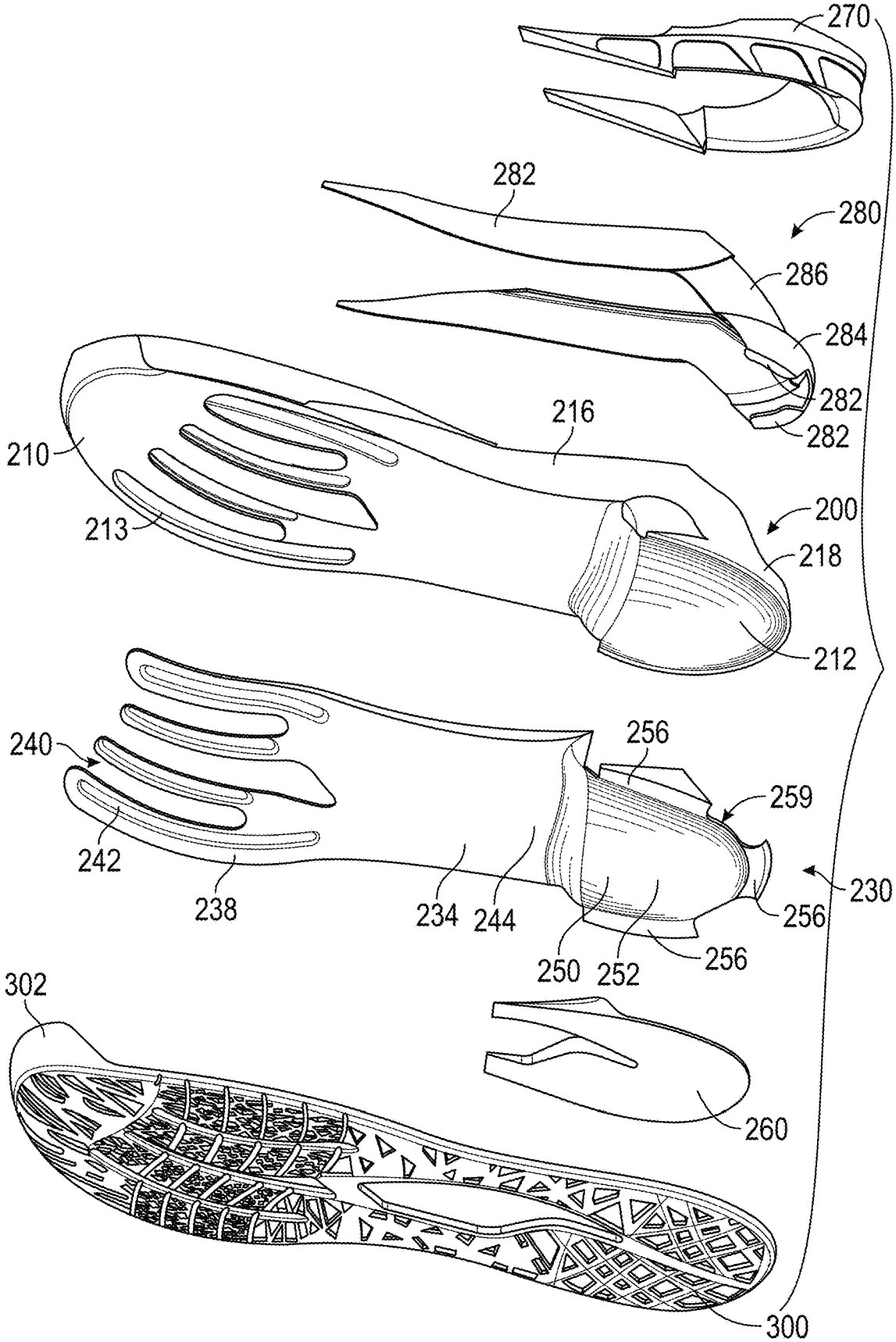
FIG. 2 is an exploded view of a sole according to some embodiments.

FIG. 2 is an exploded view of a sole assembly having midsole 200 and outsole 300, and further include a plate 230, an insert 260, a heel clip 270, and a heel rim 280. As shown, midsole 200 defines a bottom surface 210 having one or more cavities. In some embodiments, bottom surface 210 can include a dome-shaped cavity 212 disposed in a heel portion 16 of footwear 10 (e.g., FIG. 3). In some embodiments, bottom surface 210 can include cavities 213 disposed in a forefoot portion 12 of footwear 10 (e.g., FIG. 3).

In some embodiments, a plate 230 is coupled to bottom surface 210 of midsole 200. Plate 230 may be made of thermoplastic polyurethane (TPU) and carbon fiber and is thinner than midsole 200. Plate 230 may define a heel support portion 250, multiple prongs 238, and a connecting portion 244 connecting heel support portion 250 and prongs 238. In some embodiments, carbon fiber in plate 230 may be concentrated in prongs 238 and disposed within cavities 213 in forefoot portion 12, so that prongs 238 can provide a spring-like effect that increases energy return during activities such as running. In some embodiments, heel support portion 250 is dome-shaped and disposed within dome-shaped cavity 212 in heel portion 16 to provide vertical support in heel portion 16 during activities as weightlifting. In some embodiments, connecting portion 244 is disposed in midfoot portion 14, and therefore it defines an arch 246 that corresponds to the lateral arch of a foot. In some embodiments, connecting portion 244 may extend 10%-30% (e.g., 15%-25%) of the length of midsole 200 and 60%-100% (e.g., 70%-90%) of the maximum width of midsole 200 at midfoot portion 14. In some embodiments, the entirety of plate 230 is made of carbon fiber material, and in some other embodiments, only prongs 238 are made of carbon fiber material, and heel support portion 250 and connecting portion 244 are not made of carbon fiber material, so that prongs 238 are more rigid and resilient than the rest of plate 230.

In some embodiments, plate 230 abuts bottom surface 210 of midsole 200. In some embodiments, plate 230 can be glued or bonded to bottom surface 210 of midsole 200. Alternatively or additionally, in some embodiments, plate 230 includes upwardly extending sidewalls 236, and sidewalls 236 are glued or bonded to sidewalls 216 of midsole 200.

Heel support portion 250 may distribute forces received during activities such as lifting, without compromising the comfort and performance of footwear 10 during activities such as running. For example, dome-shaped heel support portion 250 receives vertical force loads from a user's heel during activities such as lifting. The geometry of dome-shaped heel support portion 250 allows the vertical load to be resisted without letting midsole 200 collapse. On the other hand, during activities, such as running, the forces applied at an angle (i.e., non-vertical forces) are not resisted by heel support portion 250, or are less resisted by heel support portion 250, such that heel support portion 250 allows midsole 200 to shear and collapse, providing a comfortable running experience to the user without sacrificing the stability during weightlifting. The geometric shape and design of heel support portion 250 therefore allows for increased comfort and support to a user during all kinds of activities such as lifting and running.

Figure 3:
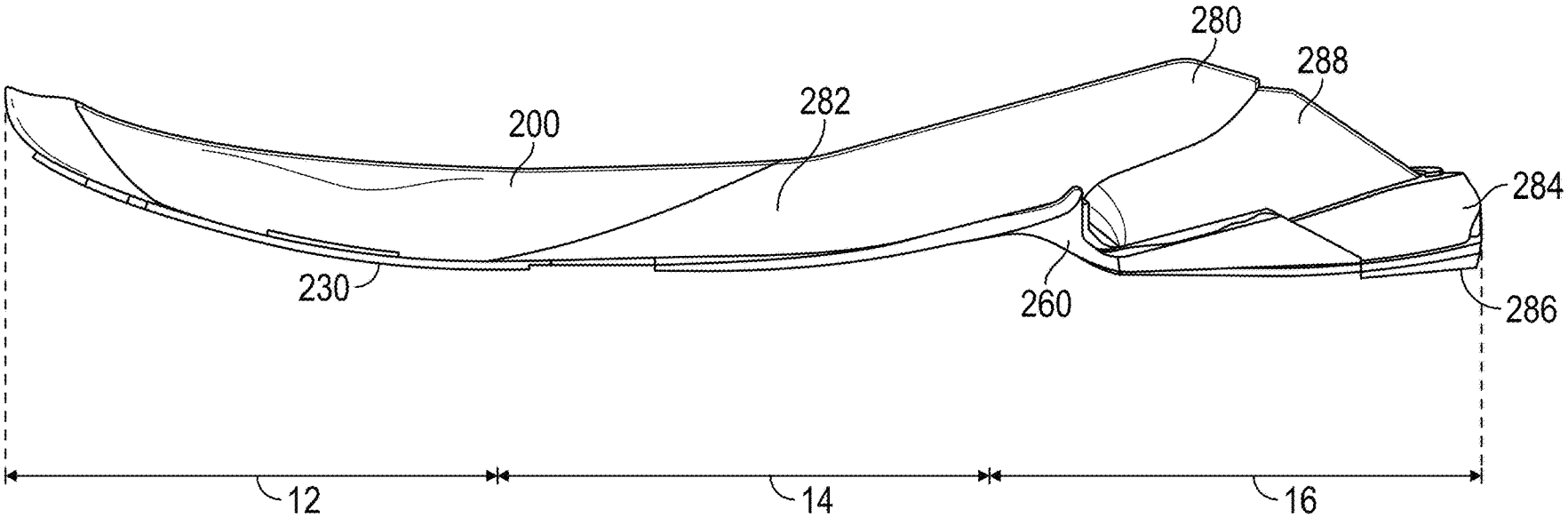
FIG. 3 is a side view of a midsole with a plate and a heel support portion according to some embodiments.
Figure 4:
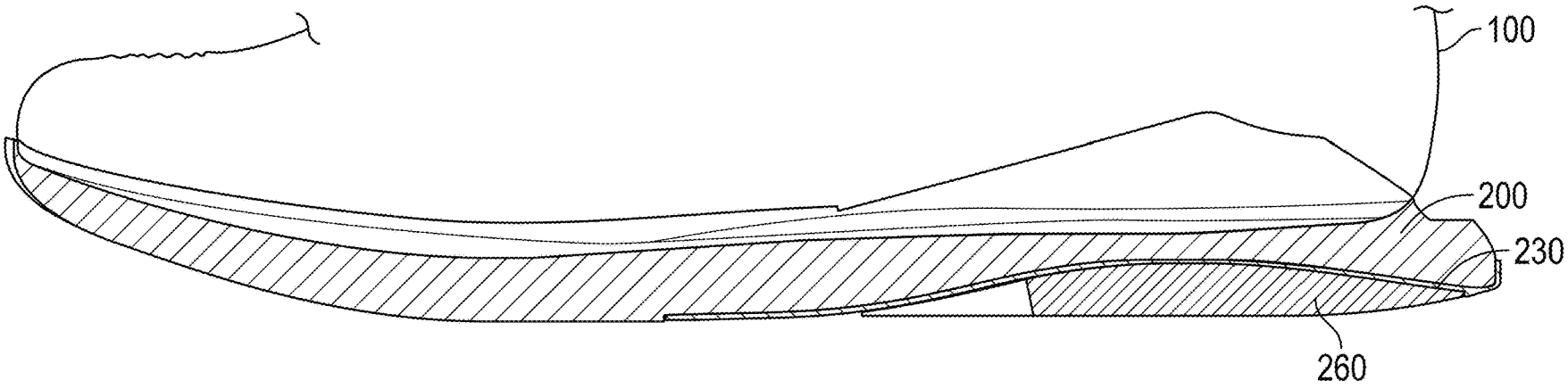
FIG. 4 is a cross-sectional view of a midsole taken along line IV-IV in FIG. 1 according to some embodiments.

In some embodiments, heel support portion 250 is disposed in heel portion 16 of footwear 10 (see e.g., FIG. 3). In some embodiments, the dome shape of heel support portion 250 extends over a majority of heel portion 16. In some embodiments, the dome shape of heel support portion 250 may extend 20%-40% (e.g., 25%-35%) of the length of midsole 200 and 60%-100% (e.g., 70%-90%) of the maximum width of midsole 200 at heel portion 16. In some embodiments, as shown in the cross-sectional view of FIG. 4, the dome shape of the heel support portion 250 has a height less than the height of midsole 200.

Figure 6:
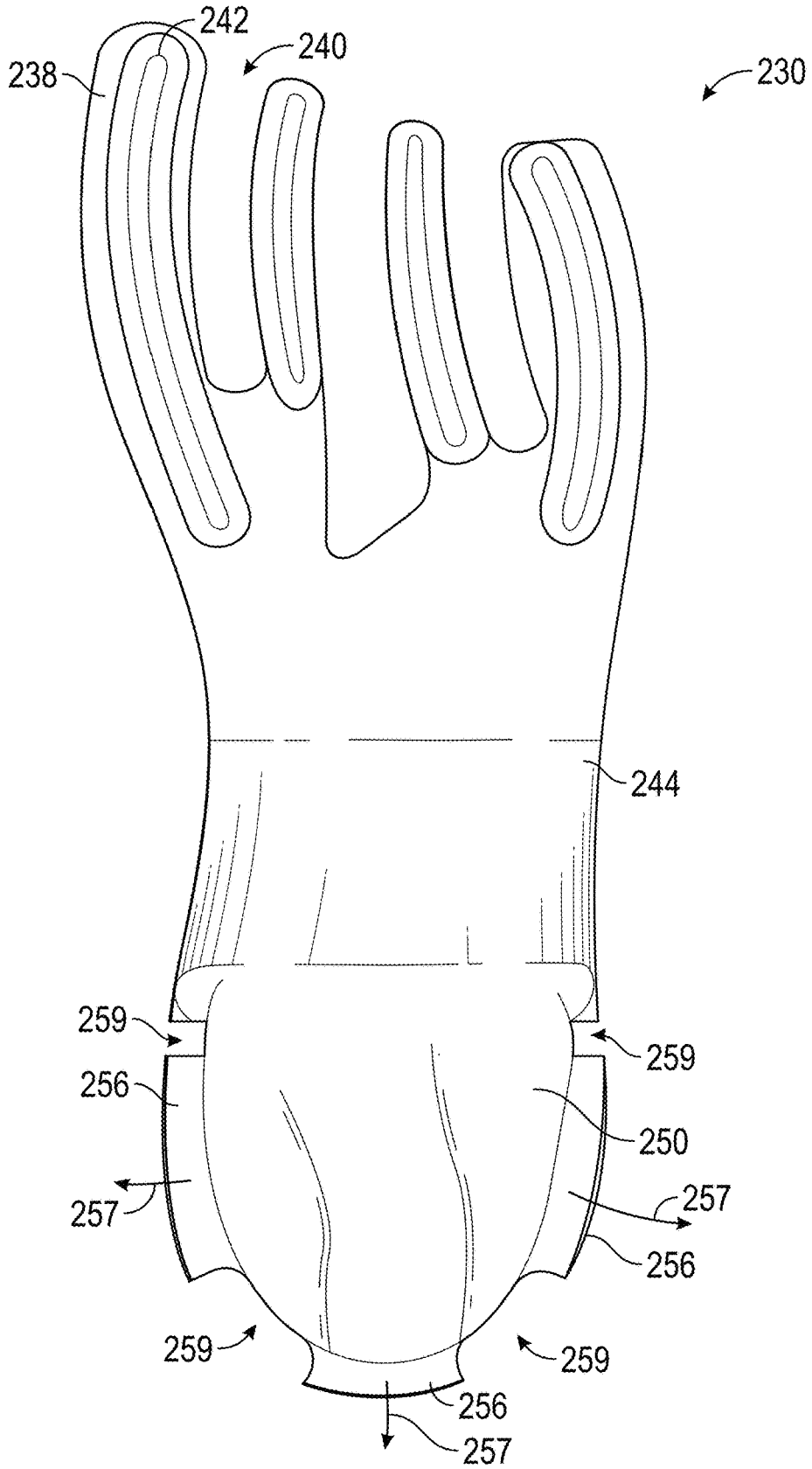
FIG. 6 is a top view of a plate for a midsole according to some embodiments.
Figure 7:
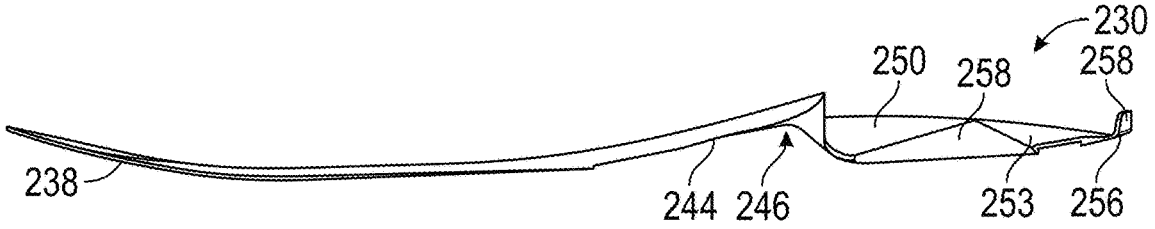
FIG. 7 is a side view of a plate for a midsole according to some embodiments.

In some embodiments, dome-shaped heel support portion 250 may include a semi-hemispherical wall 253 defining cavity 254. Semi-hemispherical wall 253 may extend uninterruptedly until a base of wall 253. In some embodiments, flanges 256 may be provided around the base of wall 253 and extending radially outwardly from wall 253. In some embodiments, each flange 256 may include a sidewall 258 extending upwardly to facilitate attachment of the heel support portion 250 to midsole 200; however, in some embodiments, flanges 256 do not include sidewall 258, such that they extend horizontally and terminate without bending upwardly. In some embodiments, flanges 256 are decoupled from each other, which means they each extend from wall 253 separately and disconnected from each other, which a space formed between each flange 256. This allows each flange 256 to move independently from each other flange, and therefore reduces the rigidity of heel support portion 250 in the lateral direction. For example, as shown in FIG. 6, when a vertical force is applied to heel support portion 250 flanges 256 allow heel support portion 250 to accommodate shearing forces in different lateral directions as indicated by arrows 257, and because flanges 256 are decoupled and move independently, the shearing motion in one direction does not restrict the shearing motion in another direction.

Figure 5:
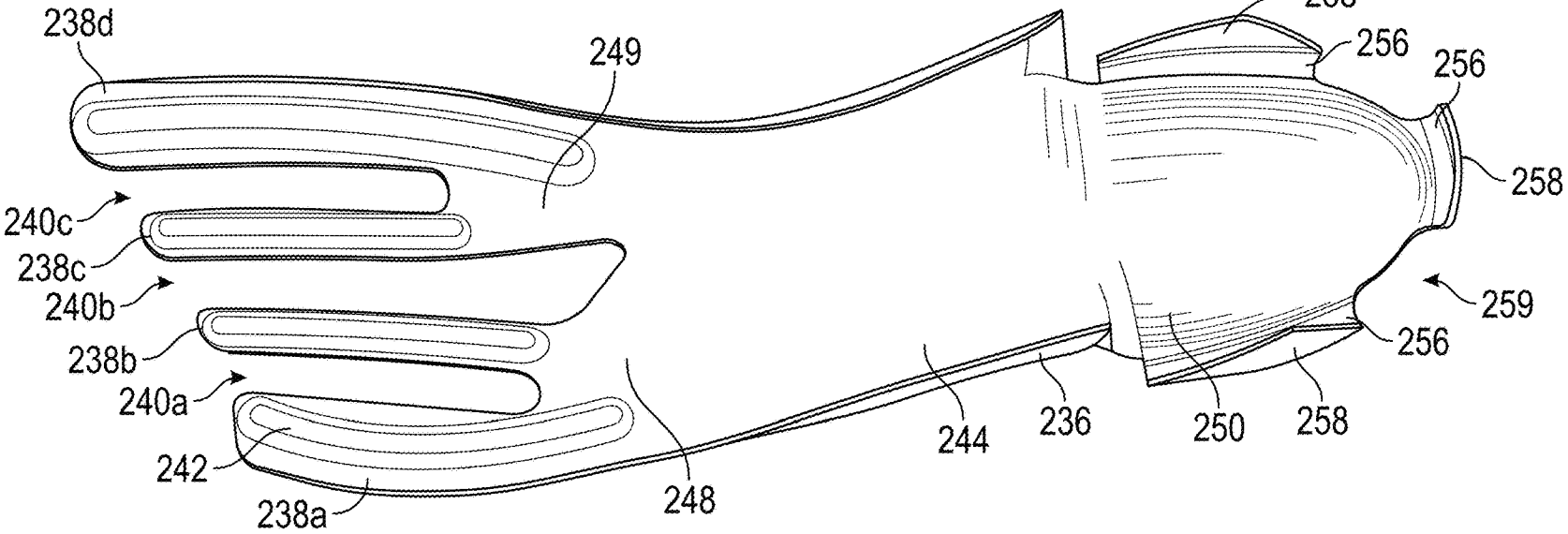
FIG. 5 is an upper perspective view of a plate for a midsole according to some embodiments.

Prongs 238 may be made of a resilient material such as, for example, carbon fiber to provide strength and increase energy return in forefoot portion 12 during activities such as running. Prongs 238 may be longitudinally extending prongs with longitudinal gaps 240 between any two prongs. The number and shape of prongs 238 and gaps 240 may be designed to suit particular exercising patterns. For example, prongs 238 may be shaped to correspond with the shape of the toes and the transverse arch of a foot, where energy return is most beneficial during running. As shown in FIGS. 5 and 6, in some embodiments, plate 230 may include four prongs 238 and three gaps 240 between each two of prongs 238. FIG. 5 shows a plate 230 for a left foot, and the rightmost prong 238 is the longest. FIG. 6 shows a plate 230 for right foot, and the leftmost prong 238 is the longest. The middle gap 240 can extend the deepest into the body of plate 230 because it corresponds to the center of the transverse arch of a foot, where there is less contact between the foot and the ground.

In some embodiments, prongs 238 may extend 20%-40% (e.g., 25%-35%) of the length of midsole 200 and 60%-100% (e.g., 70%-90%) of the maximum width of midsole 200 at forefoot portion 12.

Prongs 238 and gaps 240 can also improve independent deflection in the transverse direction from the medial side to the lateral side. In midfoot portion 14, plate 230 is all connected and deflects as a unitary structure. Gaps 240 in forefoot portion 12 separate plate 230 into prongs 238 to allow independent deflection. Further, varying the depth of gaps 240 can achieve a phased transition of the degree of independent deflection from midfoot portion 14 to forefoot portion 12. For example, closer to midfoot portion 14, gap **240*b* in the middle is the and separates plate 230 into a lateral part 248 and a medial part 249, each of which can deflect independently. Moving towards forefoot portion 12, each of lateral part 248 and medial part 249 is separated by another shorter gap 240*a* and gap 240*c*, respectively, into two independently deflectable prongs 238*a*, 238*b*, 238*c*, and 238*d*, arranged from the lateral side to the medial side. This gives a transition from zero independently deflectable structures to two independently deflectable structures and to four independently deflectable structures from midfoot portion 14 to forefoot portion 12**.

Cavities 213 in midsole 200 may be shaped to conform to the design of prongs 238, and when prongs 238 are disposed within cavities, prongs 238 are flush with bottom surface 236 of midsole 200.

In some embodiments, each prong 238 includes an indentation 242 extending along the same direction that the prong extends. In some embodiments, indentations 242 are formed on the bottom surface of each respective prong 238, such that the bottom surface is concave, and the top surface is convex. Indentations 242 can further improve the energy return provided from prongs 238 and structural rigidity of prongs 238.

In some embodiments, midsole 200 further includes an insert 260 coupled to a bottom surface 234 of plate 230. In some embodiments, heel support portion 250 is dome-shaped and forming a cavity 254 on its bottom surface 252, and insert 260 is at least partially disposed within cavity 254.

In some embodiments, at least a portion of insert 260 is also dome-shaped. In some embodiments, insert 260 may be formed of EVA foam, eTPU, other suitable foams, and/or combinations thereof. In some embodiments, insert 260 may be formed of a foam more resilient than the foam of midsole 200.

Insert 260 can provide additional comfort and support to a user. For example, in some embodiments, midsole 200 is disposed above heel support portion 250 and insert 260 is disposed below heel support portion 250, and they are made of a material less stiff than heel support portion 250. As such, midsole 200 and insert 260 can together accommodate shearing forces in the lateral direction such as during running, while also maintaining the vertical support from heel support portion 250 during vertical movements (e.g., lifting).

Figure 8:
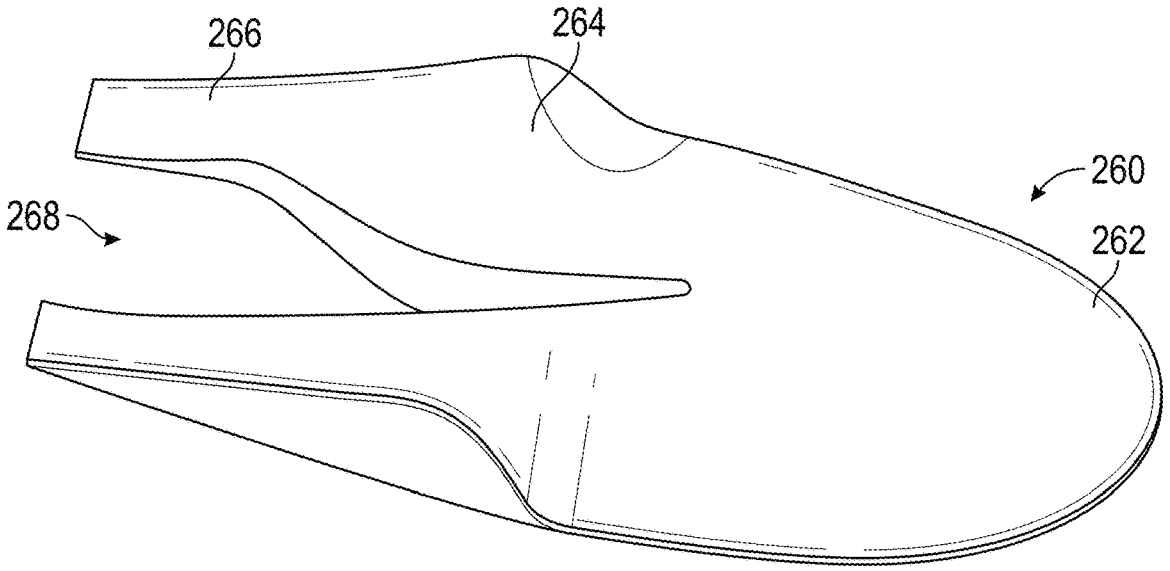
FIG. 8 is a heel insert according to some embodiments.
Figure 9:
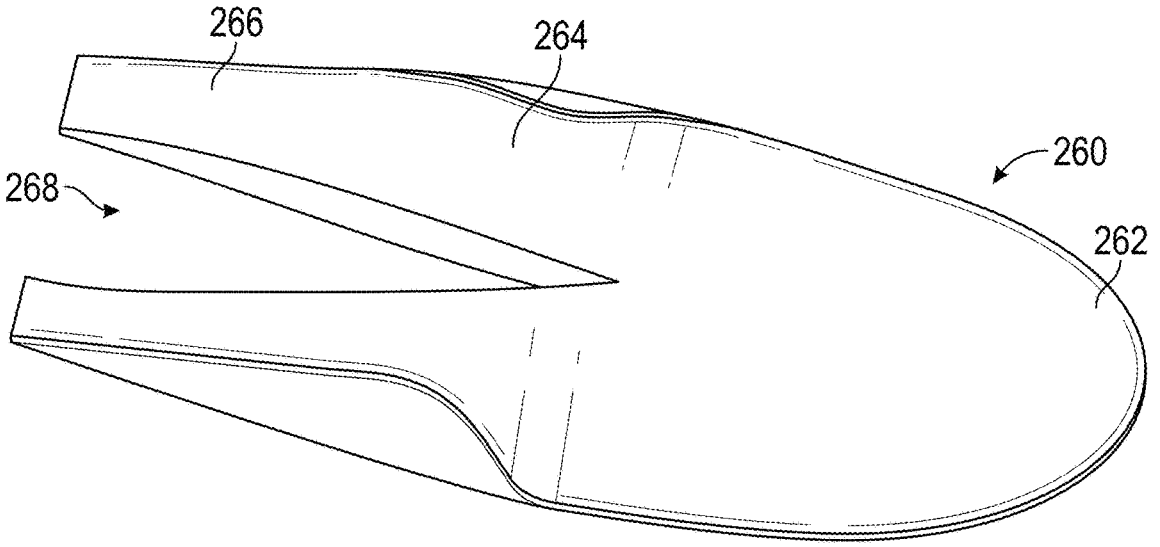
FIG. 9 is a heel insert according to some embodiments.

In some embodiments, insert 260 includes a main body 262 that is dome-shaped conforming to the shape of cavity 254, and a curve up 264 conforming to arch 246 or connecting portion 244, which extends to two prongs 266 separated by a gap 268. Prongs 266 can provide additional comfort and support in midfoot portion 14, and they may be symmetrical about a longitudinal axis of footwear 10 (see e.g., FIG. 9) or they may be asymmetrical about the longitudinal axis of footwear 10 (see e.g., FIG. 8). In some embodiments asymmetrical prongs 266 can accommodate overpronation or underpronation in a user's gait. For example, as shown in FIG. 8, prong 266 on the lateral side may be larger to help resist overpronation, or prong 266 on the medial side may be larger to help resist underpronation.

In some embodiments, when plate 230 and insert 260 are coupled to midsole 200, a heel rim 280 can be attached to midsole 200. As shown in FIG. 3, in some embodiments, heel rim 280 can surround heel 218 of midsole 200 and also extends over a portion of sidewalls 216 of midsole 200 on both the lateral side and the medial side.

Heel rim 280 can include a pair of side arms 282 coupled to sidewalls 216 of midsole 200 on the lateral side and the medial side, and each of sidewalls 216 can have an indentation that corresponds to the shape of side arms 282, so that side arms 282 are flush with sidewalls 216 when attached. In some embodiments, side arms 282 can extend from 30% to 70% of the length of sidewalls 216. Side arms 282 can extend to a bottom portion 284, which is coupled to a bottom of heel 218 of midsole 200. Side arms 282 are connected to bottom portion 284 via transit portions 288. In some embodiments, bottom portion 284 further includes securement tabs 286 that can extend over the bottom of insert 260 to secure insert 260 and plate 230 in place together with midsole 200. When assembled, at least a portion of heel rim 280 is exposed on an exterior of footwear 10.

In some embodiments, midsole 200 further includes a heel clip 270. Heel clip 270 can be disposed around heel 218 of midsole 200 over heel rim 280. In some embodiments, heel clips can cross over heel rim 280 at separate locations. For example, heel clip 270 cross over transit portion 288 of heel rim 280 at the medial side and at the lateral side, and transit portion 288 can form indentations to accommodate heel clip 270. When assembled, at least a portion of heel clip 270 is exposed on an exterior of footwear 10.

Both heel rim 280 and heel clip 270 can provide medial and lateral support to midsole 200. In some embodiments, heel rim 280 can be made of EVA foam and heel clip 270 can be made of TPU. In some embodiments, heel clip 270 may be made of a material stiffer than heel rim 280. In some embodiments, both heel rim 280 and heel clip 270 may be made of a material stiffer than midsole 200 and insert 260.

In some embodiments, heel rim 280 and heel clip 270 form a single and unitary component to allow for easier manufacturing of article of footwear 10. For example, heel rim 280 and heel clip 270 may be molded as a unitary component. Additionally, in some embodiment, heel rim 280 and heel clip 270 extends above midsole 200, so it can provide additional medial and lateral support to upper 100. For example, heel rim 280 and heel clip 270 may be made of a more rigid material than upper 100, thus allowing upper 100 to remain lightweight, while also providing stability during athletic activities, especially around the heel area.

In some embodiments, article of footwear 10 includes outsole 300 attached to midsole 200 and covering heel support portion 250 and insert 260. In the embodiments where securement tabs 286 of rim 280 extends over the bottom surface of insert 260, outsole 300 also covers securement tabs 286. In some embodiments, outsole 300 includes a lip 302 to couple with the front of midsole 200.

In some embodiments, outsole 300 may cover the entirety of the bottom surface of midsole 200 (including heel support portion 250 and insert 260). In some embodiments, outsole 300 may selectively cover only portions of the bottom surface midsole 200 (including heel support portion 250 and insert 260) that would undergo the most forces during physical activity, such as a forefoot portion 12, midfoot portion 14, and heel portion 16. Within each portion, outsole 300 may be even further selectively disposed such that it covers the most commonly worn areas within each portion for a specific type of runner. For example, as shown in FIG. 2, outsole 300 covers primarily forefoot portion 12 and heel portion 16, and within forefoot portion 12, outsole 300 is cut to correspond to the shape of prongs 238, within heel portion 16, outsole 300 covers heel support portion 250 and insert 260. It is recognized that prongs 238, heel support portion 250, and insert 260 are the most worn areas within footwear 10. In some embodiments, article of footwear 10 does not include an outsole 300.

An exemplary method of manufacturing footwear 10 is described. In some embodiments, midsole 200 may be manufactured by injection molding. In some embodiments, midsole 200 is molded with one or more cavities 212, 213. In some embodiments, plate 230 is separately manufactured with carbon fiber and coupled to midsole 200 with heel support portion 250 and prongs 238 disposed within cavities 212, 213. Plate 230 may be bonded or not bonded to midsole 200. In some embodiments, insert 260 is injected within cavity 254 and/or arch 246 of heel support portion 250, and in some other embodiments, insert 260 is separately molded and coupled to heel support portion 250, with at least a portion disposed within cavity 254. Insert 260 may be bonded or may be not bonded to heel support portion 250.

Heel rim 280 and heel clip 270 may be separately manufactured and coupled to midsole 200 after heel support portion 250 and insert 260 are assembled. In some embodiments, heel clip 270 is coupled to midsole 200 after heel rim 280 is coupled to midsole 200. In some embodiments, heel rim 280 and heel clip 270 are manufactured as a single unitary component and are coupled to midsole 200 together. When heel rim 280 is coupled to midsole 200, securement tabs 286 may extend over the bottom of insert 260, such that heel rim 280 clips midsole 200, plate 230, insert 260 together to secure plate 230 and insert 260 in place.

Upper 100 may be separately manufactured and coupled to midsole 200 after heel rim 280 and heel clip 270 are assembled. Finally, in some embodiments, outsole 300 is attached to bottom surface 210 of midsole 200.

It is to be appreciated that the Detailed Description section, and not the Summary and Abstract sections, is intended to be used to interpret the claims. The Summary and Abstract sections can set forth one or more but not all exemplary embodiments of the present embodiments as contemplated by the inventor(s), and thus, are not intended to limit the present embodiments and the appended claims in any way.

The foregoing description of the specific embodiments will so fully reveal the general nature of the embodiments that others can, by applying knowledge within the skill of the art, readily modify and/or adapt for various applications such specific embodiments, without undue experimentation, without departing from the general concept of the present disclosure. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

The breadth and scope of the present disclosure should not be limited by any of the above-described exemplary embodiments, but should be defined only in accordance with the claims and their equivalents.

What is claimed is:

1. A sole for an article of footwear, the sole comprising:
- a midsole;
- a plate comprising:
  - four longitudinal prongs separated by three longitudinal gaps in a forefoot portion of the sole; and
  - a dome-shaped heel support portion in a heel portion of the sole;
- an insert disposed within a cavity formed on a bottom surface of the heel support portion;
- a heel rim securing the insert to the plate, and the heel rim securing the plate to the midsole; and
- an outsole.

2. The sole of claim 1, wherein the plate is thinner than the midsole.

3. The sole of claim 1, wherein the insert is more resilient than the midsole under compression.

4. The sole of claim 1, wherein the plate comprises carbon fiber and is more rigid than the midsole and the insert.

5. The sole of claim 1, wherein two of the longitudinal prongs of the plate are separated by a longitudinal gap.

6. The sole of claim 1, wherein the longitudinal prongs are more rigid than rest of the plate.

7. The sole of claim 6, wherein each of the longitudinal prongs comprises a longitudinal indentation formed on a bottom surface of the respective longitudinal prong.

8. The sole of claim 1, wherein the middle longitudinal gap of the three longitudinal gaps extends deeper into the plate than the other two longitudinal gaps.

9. The sole of claim 1, wherein a bottom surface of the midsole comprises cavities, and wherein the longitudinal prongs are at least partially disposed within the cavities.

10. The sole of claim 1, wherein a bottom surface of the midsole comprises a dome-shaped cavity, and wherein the heel support portion is disposed within the dome-shaped cavity, with the heel support portion abutting a bottom surface of the midsole.

11. The sole of claim 1, wherein the insert is asymmetrical in the direction from a lateral side to a medial side.

12. An article of footwear, comprising:
- an upper; and
- the sole of claim 1.

13. A sole for an article of footwear, the sole comprising:
- a midsole comprising a dome-shaped cavity on a bottom surface of the midsole and in a heel portion;
- a dome-shaped heel support disposed underneath the midsole portion, the heel support comprising:
  - a dome-shaped wall defining a cavity on a bottom surface of the heel support, the dome-shaped wall disposed within the dome-shaped cavity of the midsole and abutting the bottom surface of the midsole; and
  - flanges extending radially outwardly from an edge of the dome-shaped wall, the flanges being decoupled from each other;
- an insert disposed within the cavity of the heel support; and
- a heel rim securing the insert to the heel support, and the heel rim securing the heel support to the midsole.

14. The sole of claim 13, wherein the flanges of the heel support portion comprise three flanges extending radially outwardly from the edge, with a first flange on a lateral side, a second flange on a medial side, and a third flange on a rear side.

15. The sole of claim 13, wherein each of the flanges comprises a sidewall extending upwardly and coupled to a sidewall of the midsole.

16. The sole of claim 13, wherein each of the flanges comprises a sidewall to engage with a sidewall of the midsole.

17. The sole of claim 13, further comprising an outsole, wherein the insert is disposed between the outsole and the heel support.

18. An article of footwear, comprising:
- a sole, comprising:
  - a midsole;
  - a plate comprising longitudinal prongs in a forefoot portion of the sole and a dome-shaped heel support portion in a heel portion of the sole;
  - an insert disposed within a cavity formed on a bottom surface of the heel support portion;
  - a heel rim securing the insert to the plate, and the heel rim securing the plate to the midsole; and
  - an outsole; and
- a heel clip disposed around the heel portion of the sole and crossing over the heel rim at separate locations: one at a medial side and one at a lateral side.

19. The article of footwear of claim 18, wherein the heel clip is stiffer than the heel rim.

20. The article of footwear of claim 18, wherein a portion of the heel rim is exposed on an exterior of the article of footwear.

* * * * *